US008096614B2

(12) United States Patent
Lin

(10) Patent No.: US 8,096,614 B2
(45) Date of Patent: Jan. 17, 2012

(54) LOCKING MECHANISM

(75) Inventor: Tony Lin, Dong Guan (CN)

(73) Assignee: Zhi Jia Furniture Ltd., Dong Guan, Guangdong Province (CN)

( * ) Notice: Subject to any disclaimer, the term of this patent is extended or adjusted under 35 U.S.C. 154(b) by 125 days.

(21) Appl. No.: 12/689,731

(22) Filed: Jan. 19, 2010

(65) Prior Publication Data

US 2011/0175413 A1 Jul. 21, 2011

(51) Int. Cl.
*A47C 3/03* (2006.01)

(52) U.S. Cl. ..... 297/270.4; 297/270.3

(58) Field of Classification Search ..... 297/270.1, 297/270.3, 259.3, 281, 270.4, 270.2
See application file for complete search history.

(56) References Cited

U.S. PATENT DOCUMENTS 1,555,689 A * 9/1925 Miller ..... 297/262.1
2,302,387 A * 11/1942 Greeno et al. ..... 248/370
3,815,954 A 6/1974 Rogers, Jr. et al.
3,904,240 A 9/1975 Rogers, Jr. et al.
4,212,494 A 7/1980 Dabney
4,601,513 A 7/1986 Pine
4,893,871 A 1/1990 Kowalski
4,911,499 A * 3/1990 Meeker ..... 297/260.2
5,121,967 A 6/1992 Rogers
5,248,120 A 9/1993 Brien
5,344,214 A 9/1994 Trent
5,527,095 A 6/1996 Marshall et al.
5,704,686 A 1/1998 May
5,749,625 A 5/1998 Robinson
5,765,913 A 6/1998 LaPointe et al.
5,795,021 A 8/1998 Rogers
6,033,020 A 3/2000 Ito
6,120,094 A * 9/2000 Parent ..... 297/270.1
6,213,551 B1 * 4/2001 Desnoyers et al. ..... 297/270.4
6,588,841 B1 * 7/2003 Hoffman et al. ..... 297/270.3
2007/0096522 A1 * 5/2007 Bergeron ..... 297/270.1

* cited by examiner

*Primary Examiner* — Milton Nelson, Jr.
(74) *Attorney, Agent, or Firm* — Jackson IPG PLLC; Demian K. Jackson

(57) ABSTRACT

A locking mechanism for a glider rocker having a gliding chair seat mounted on a stationary base, including an operating assembly mounted on the gliding chair seat, a pair of bearing brackets mounted on the stationary base respectively, and a pair of mounting assemblies. Each mounting assembly includes a prop, a strut, a curved elongated member, a mounting bracket, and a restoring spring connected with the curved elongated member and the prop.

8 Claims, 7 Drawing Sheets

LOCKING MECHANISM

FIELD OF THE INVENTION

This invention relates to an improved locking mechanism for glider rocker, designed in particular for durability, flexibility and stability.

BACKGROUND OF THE INVENTION

No matter rocking reclining, gliding chair or other device with rocking and gliding motion, they all need mechanisms to lock in a desired position. Numerous locking mechanisms have been proposed over the years, illustrating the state of the art, and it can be found in U.S. Pat. No. 3,815,954 (Rogers, Jr. et al.); U.S. Pat. No. 3,904,240 (Rogers et al.); U.S. Pat. No. 4,212,494 (Dabney); U.S. Pat. No. 4,601,513 (Pine); U.S. Pat. No. 4,893,871 (Kowalski); U.S. Pat. No. 5,121,967 (Rogers); U.S. Pat. No. 5,248,120 (Brien); U.S. Pat. No. 5,344,214 (Trent); U.S. Pat. No. 5,527,095 (Marshall et al); U.S. Pat. No. 5,704,686 (May); U.S. Pat. No. 5,749,625 (Robinson); U.S. Pat. No. 5,765,913 (LaPointe et al.); U.S. Pat. No. 5,795,021 (Rogers); and U.S. Pat. No. 6,033,020 (Ito). However the locking mechanisms mentioned in the above patent are too complex.

Also well known in the art is the U.S. Pat. No. 6,213,551 (Desnoyers et al.) and U.S. Pat. No. 6,464,295 (Bergeron et al.). The U.S. Pat. No. 6,213,551 shows a locking mechanism for a glider rocker, which has toothed rails and locking pins respectively mounted on the rocker's base and gliding seat, and the locking engagement of the pins between teeth of the rails can stop movement of the gliding seat with respect to the base. The design of the mechanism is however prone to disengagement of the rails from the pins, which may happen at undesired times and may be unsafe. The U.S. Pat. No. 6,464,295 also shows a locking assembly for a glider rocker having a gliding chair seat mounted on a stationary base, which concludes a latch bar adapted to extend horizontally and transversely with respect to a gliding direction of the chair seat; mounting means for attaching the latch bar to the chair seat, and a bracket affixable to the base and having an upper end provided with a downwardly extending catch slot into which the latch bar slideably fits when the latch bar is aligned therewith and lowered by operation of the mounting means. However the design of the locking assembly is not tend to restore to the retracted position when it is in the deployed position and the mounting means may be unstable and unsafe in the deployed position.

SUMMARY OF INVENTION

An object of the invention is to provide a much safer and more stable locking mechanism for a glider rocker by adding a blocking bar on the longitudinal face of the curved elongated member to support the strut.

Another object of the invention is to provide a more flexible locking mechanism for a glider rocker, which is easy to restore to the retracted position when in the deployed position by the bounce of the restoring spring fixed to the prop and the curved elongated member.

The third object of the invention is to provide such a locking mechanism for a glider rocker with safety, stability and flexibility.

According to the present invention, there is provided a locking mechanism for a glider rocker having a gliding chair seat mounted on a stationary base, comprising:

an operating assembly mounted on the gliding chair seat;

a pair of bearing brackets mounted on the stationary base respectively and each bearing bracket having an upper end provided with downwardly extending catch slots with same depths;

a pair of mounting assemblies, each mounting assembly comprising:

a) a prop fixed to the operating assembly and having a pin on the longitudinal face of said prop;

b) a strut connected to the prop pivotally and having a groove;

c) a curved elongated member connected to the strut pivotally and having a longitudinal face from which latch bars and a blocking bar transversely projects, the latch bars spaced along the length of the curved elongated member with respect to a gliding direction of the gliding chair seat; the blocking bar fit to the groove of the strut; the curved elongated member also having a pin on the reverse longitudinal face;

d) a mounting bracket with one end fixed to the gliding chair seat and the other end fixed to the curved elongated member pivotally;

e) a restoring spring connected with the curved elongated member and the prop.

The restoring spring is fixed by the pin on the longitudinal face of the curved elongated member and the pin on the longitudinal face of the prop.

The operating assembly comprises:

a) a handle to manipulate the locking mechanism;

b) a lever mounted on the gliding chair seat traversely and having one end connected to the handle.

The lever mounted to the gliding chair seat was fixed by a tenon.

BRIEF DESCRIPTION OF THE DRAWINGS

A detailed description of preferred embodiment will be given herein below with reference to the following drawings, in which like numbers refer to like elements.

DETAILED DESCRIPTION OF THE PREFERRED EMBODIMENTS

Figure 1:
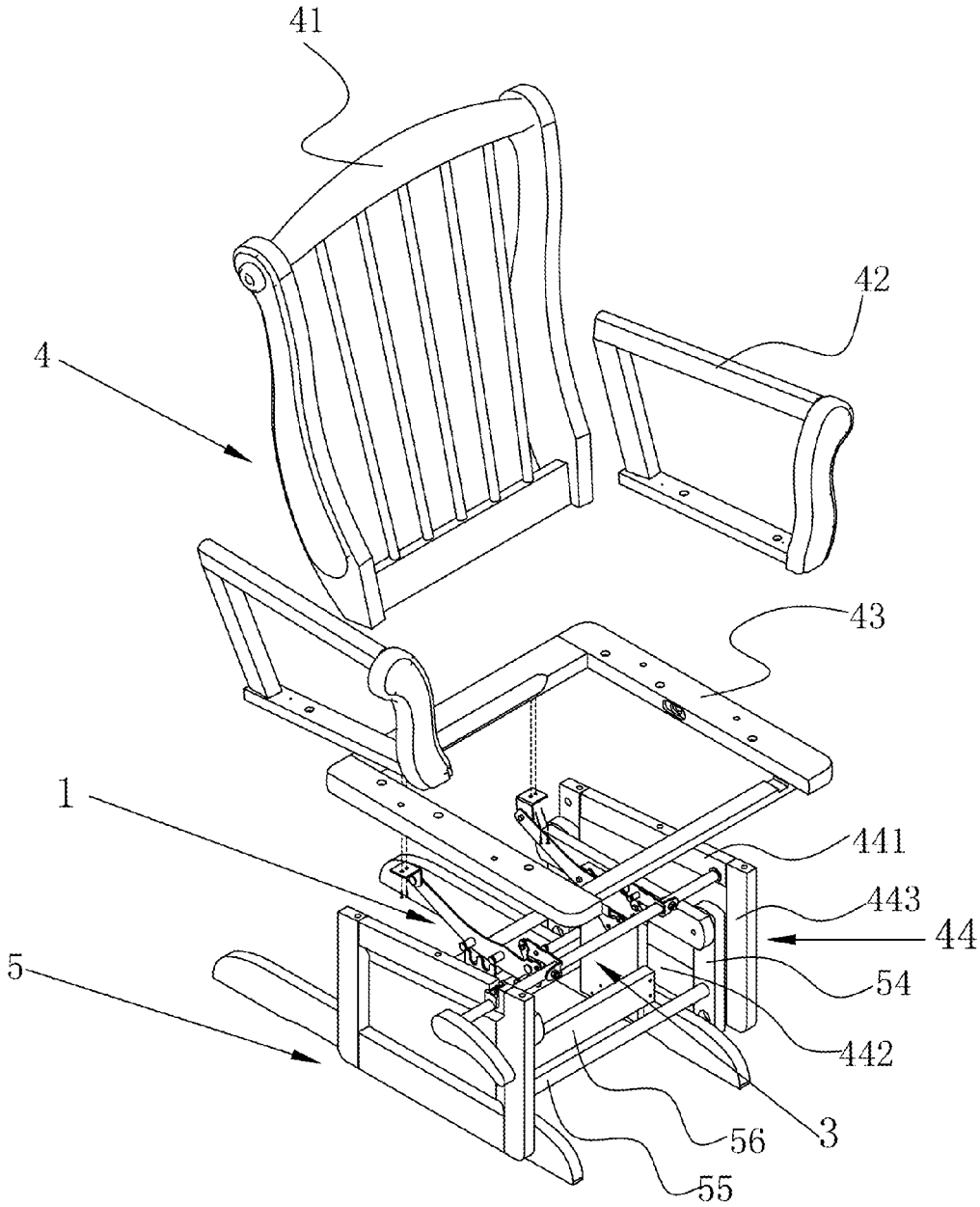
FIG. 1 is an exploded view of the glider rocker equipped with the locking mechanism.

Referring to FIG. 1, a glider rocker equipped with a locking mechanism according to the invention is shown. The glider rocker has a gliding chair seat 4 mounted on a stationary base 5.

Figure 8:
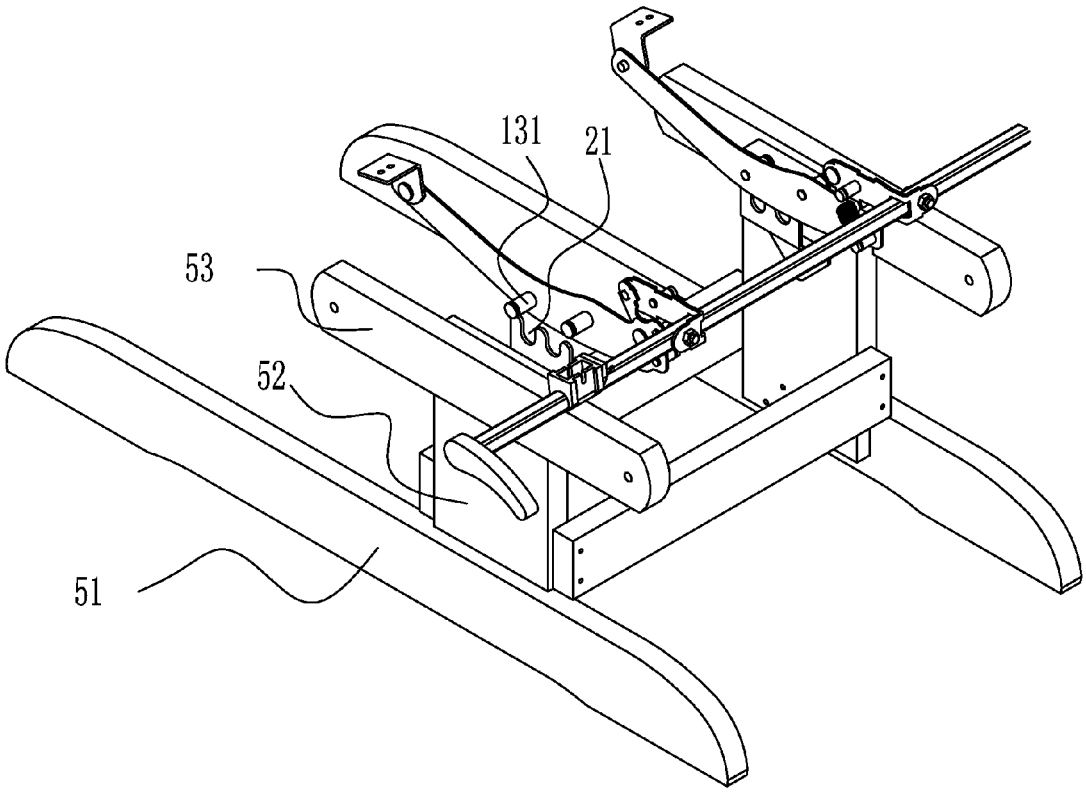
FIG. 8 is a view of the locking mechanism fixed on the stationary base in retracted (unlocked) position.
Figure 9:
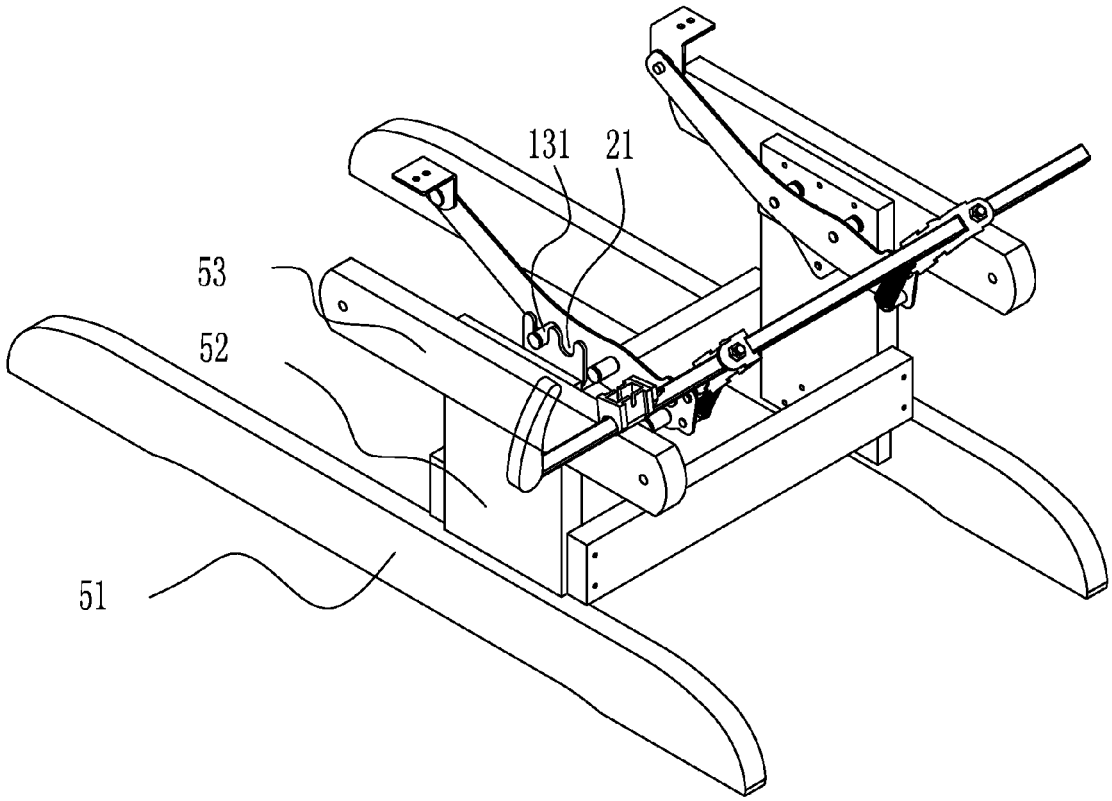
FIG. 9 is a view of the locking mechanism fixed on the stationary base in deployed (locked) position.

The stationary base 5 include a pair of parallel lower supports 51, a pair of parallel upright supports 52 extending on a pair of parallel lower supports 51 respectively, a pair of parallel upper supports 53 supported by upright supports 52 respectively, forming I-shaped figures on each side of the glider rocker, as best shown in FIG. 8 and FIG. 9. The stationary base 5 also includes front and rear parallel linkage bars 54 connected with the upper supports 53 respectively, and the front linkage bars 54 and the rear linkage bar 54 are connected by rods 55 respectively. There is also a support plate 56 connected to the pair of parallel upright supports 52 to make the stationary base 5 stable.

The gliding chair seat 4 includes a back portion 41, a pair of chair arms 42, a seat portion 43, and a pair of parallel downwardly projecting side support members 44 extending on the opposite sides of seat portion 43 and on outer sides of the stationary base 5 of the gliding chair seat 4. The side support members 44 include one upper beam 441, one lower beam 442, and two bars 443 extending between the upper beam 441 and the lower beam 442 as illustrated in FIG. 1.

Figure 2:
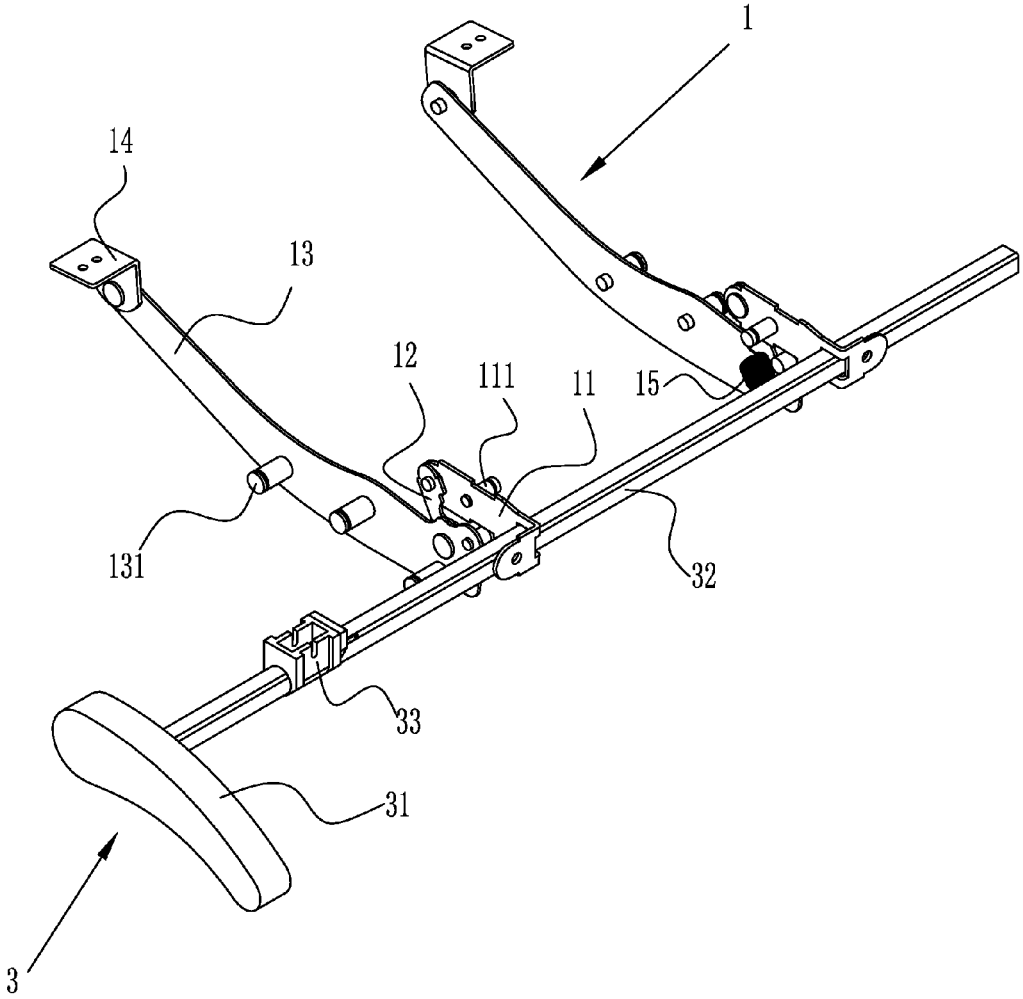
FIG. 2 is a view of the locking mechanism with the bearing bracket omitted.

A locking mechanism for a glider rocker having a gliding chair seat 4 mounted on a stationary base 5 is shown in FIG. 2, comprising a pair of a pair of mounting assemblies 1, a bearing bracket 2, and an operating assembly 3.

Figure 3:
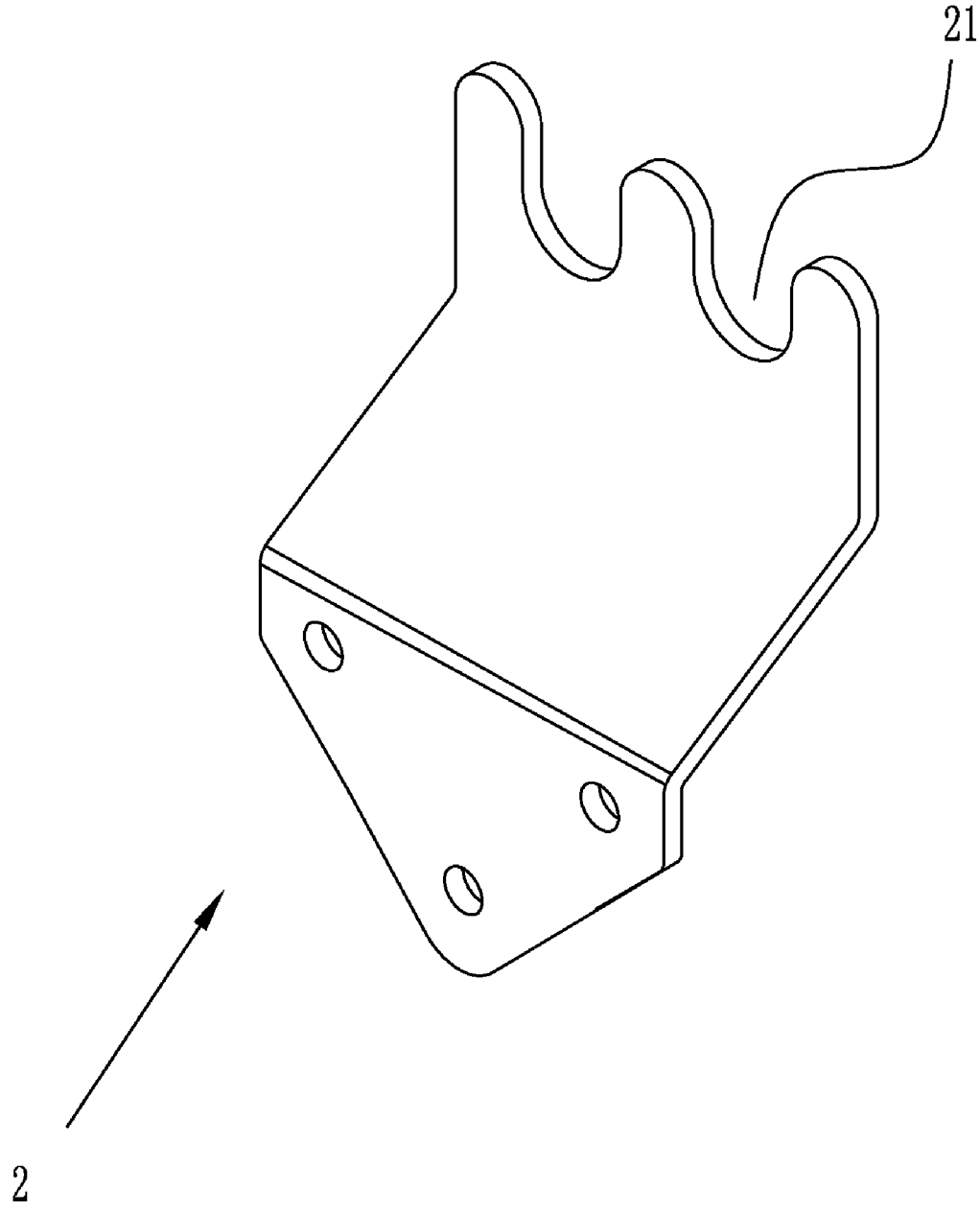
FIG. 3 is a view of the bearing bracket.
Figure 4:
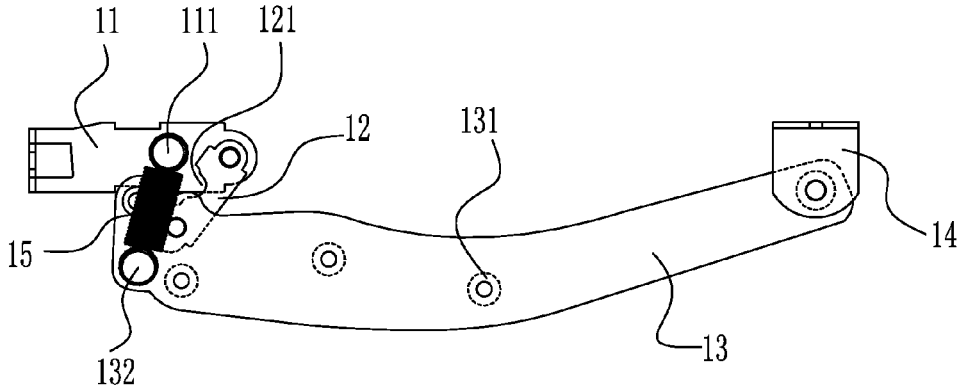
FIG. 4 is a perspective view of the mounting assembly in retracted (unlocked) position.
Figure 5:
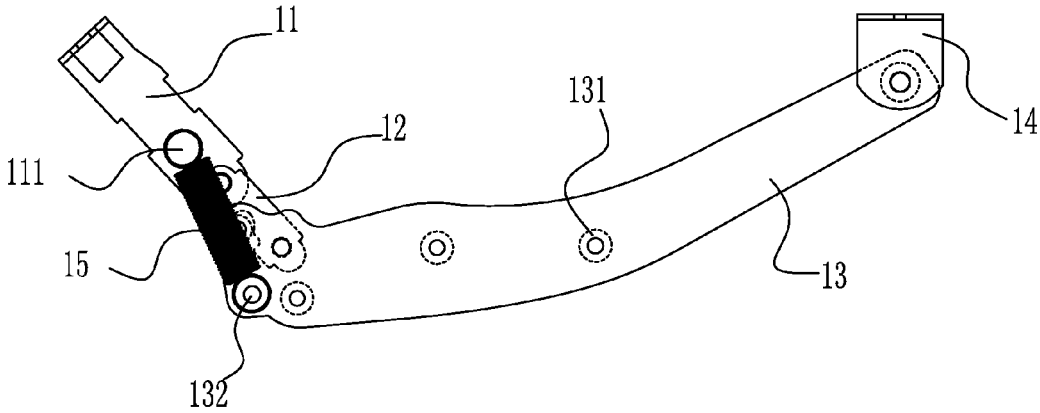
FIG. 5 is a perspective view of the mounting assembly in deployed (locked) position.
Figure 6:
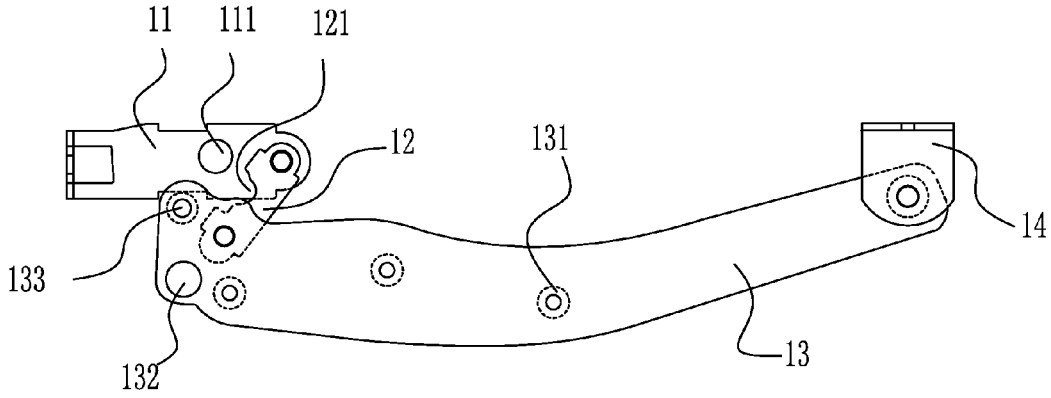
FIG. 6 is a perspective view of the mounting assembly in retracted (unlocked) position with the restoring spring omitted.
Figure 7:
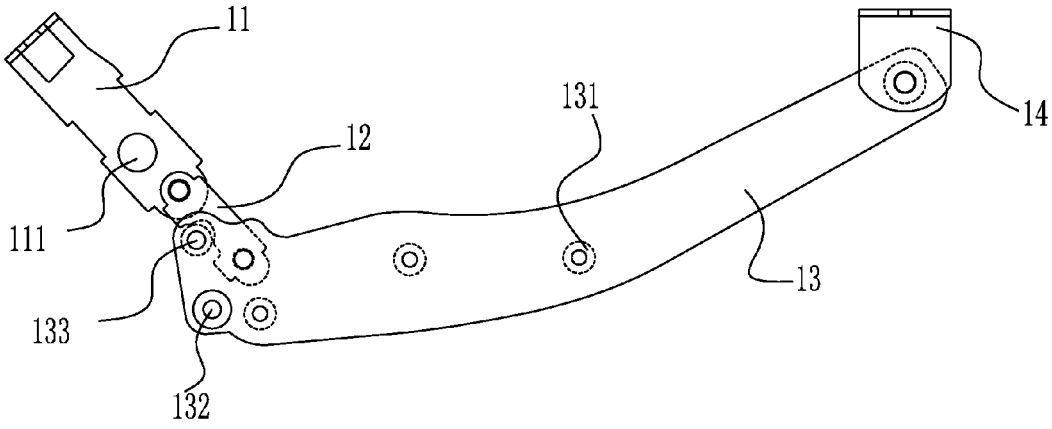
FIG. 7 is a perspective view of the mounting assembly deployed (locked) position with the restoring spring omitted.

Referring to FIG. 1 and FIG. 3, the pair of bearing brackets 2 mounted to the upright supports 52 of the stationary base 5 respectively, the lower end of the bearing bracket 2 is fixed to the upright supports 52 of the stationary base 5, and the upper end of the bearing bracket 2 provides downwardly extending catch slots 21 with same depths. The number of the catch slots 21 is two but not limited to two.

Each mounting assembly 1 comprises a prop 11, a strut 12, a curved elongated member 13, a mounting bracket 14, and a restoring spring 15, as shown in FIG. 4, FIG. 5, FIG. 6, and FIG. 7. One end of the prop 11 is fixed to the strut 12 pivotally, and the other end of the prop 11 is bended and is fixed to the lever 32. There is a hole in the prop which can be gone through by the lever 32. When rotated, the lever 32 can bring the mounting assembly 1 retract or deploy. That is to say, the latch bar 131 on the longitudinal face of the curved elongated member 13 will be pulled out of the catch slot 21 and unlock the glider rocker when the mounting assembly 1 is in the retract position; conversely, the latch bar 131 on the longitudinal face of the curved elongated member 13 will be inserted into the catch slot 21 and lock the glider rocker. There is also a pin 111 transversely projecting from the longitudinal face of the prop 11, which is used to fix the restoring spring 15. The strut 12 is connected to the curved elongated member 13 pivotally with one end, and there is also a groove 121 of the strut 12. The curved elongated member 13 is connected to the mounting bracket 14 with one end pivotally. The curved elongated member 13 has a longitudinal face from which latch bars 131 transversely projects, and the latch bars 131 are spaced along the length of the curved elongated member 13 with respect to a gliding direction of the gliding chair seat 4, which is fit to the catch slots 21 with same depths of the bearing bracket 2 when locked. On the end of the longitudinal face of curved elongated member 13 close to the strut 12 there is a blocking bar 133 which fit to the groove 121 of the strut 12. The blocking bar 133 can support the strut 12, only in this way can the strut 12 be blocked when the locking mechanism is locked, avoiding the strut 12 is offset from its balance position. On the reverse longitudinal face of the curved elongated member 13 there is a pin 132, the pin 132 on the longitudinal face of the curved elongated member 13 and the pin 111 on the longitudinal face of the prop 11 are connected to the two ends of the restoring spring 15. When release the locking mechanism, the bounce of the restoring spring 15 can bring the latch bar 131 get away from the catch slots 21 of the bearing bracket 2, which means it is easy to restore to the retracted position when it is in the deployed position by adding the restoring spring 15.

One end of the mounting bracket 14 is fixed to the rear underside of the seat portion of the gliding chair seat 4 by screw; another end of the mounting bracket 14 is pivotally connected to the curved elongated member 13;

The operating assembly 3 to manipulate the mounting assembly 1 comprises a lever 32 and a handle 31, as best shown in FIG. 2.

The lever 32 is mounted to the upper beams of the gliding chair seat 4 traversely. One end of the lever 32 is inserted to the hole of one upper beam directly; the other end of the lever 32 is fixed to the groove of the other upper beam by a tenon 33 and penetrates through the upper beam connecting to the handle 31. The cross section of the lever 32 is square but not limited to square which can drive the movement of the locking mechanism.

A handle 31 is connected to the lever 32, and just by operating the handle 31 it can easily lock and unlocked the glider rocker.

The operation of the locking mechanism will now be described. When it is desired to lock the glider rocker in a particular position within its range of movement relative to the stationary base 5, as shown in FIG. 9, the lever 32 is manipulated by the handle 31 to bring the mounting assembly 1 to move until the latch bar 131 on the longitudinal face of the curved elongated member 13 is inserted into the catch slot 21 and lock the glider rocker. By this time the prop 11 and the strut 12 turn to a more straightened position, the cooperation of the blocking bar 133 on the curved elongated member 13 and the groove 121 of the strut 12 can support the strut 12 and avoid the excess offset of the strut 12, which makes the glider rocker much safer and more stable.

When it is desired to unlock the glider rocker with the mounting assembly in retracted position, as shown in FIG. 8, the lever 32 is manipulated by the handle 31 to bring the mounting assembly 1 to move until the latch bar 131 on the longitudinal face of the curved elongated member 13 are raised off from the catch slot 21 of the bearing bracket 2 and therefore the rocking and gliding motion of the glider rocker can take place without any interference from the locking mechanism. The bounce of the restoring spring 15 can bring the latch bar 131 get away from the catch slots 21 of the bearing bracket 2 easily, in other words, it is easy and flexible to unlock the glider rocker.

It will be evident to those skilled in the art that changes and modifications may be made therein without departing from the essence of this invention. All such modifications or variations are believed to be within the scope of the invention as defined by the claims appended hereto.

What is claimed is:

1. A locking mechanism for a glider rocker having a gliding chair seat mounted on a stationary base, comprising:

an operating assembly configured to be mounted on the gliding chair seat when said locking mechanism is assembled with the gliding chair seat;

a pair of bearing brackets mounted on said stationary base respectively and each bearing bracket having an upper end provided with downwardly extending catch slots with equal depths; and a pair of mounting assemblies, each said mounting assembly comprising:

a) a prop fixed to said operating assembly and having a pin on a longitudinal face of said prop;

b) a strut connected to said prop pivotally and having a groove;

c) a curved elongated member connected to said strut pivotally and having a longitudinal face from which latch bars and a blocking bar transversely projects, said latch bars spaced along the length of said curved elongated member with respect to a gliding direction of said gliding chair seat; said blocking bar fit to said groove of said strut; said curved elongated member also having a pin on a reverse longitudinal face;

d) a mounting bracket with one end fixable to said gliding chair seat and another end fixed to said curved elongated member pivotally; and e) a restoring spring connected with said curved elongated member and said prop.

2. The locking mechanism according to claim 1, said restoring spring is fixed by said pin on the longitudinal face of said curved elongated member and said pin on the longitudinal face of said prop.

3. The locking mechanism according to claim 1, said operating assembly comprising:

a) a handle to manipulate said locking mechanism; and b) a lever configured to be mounted on the gliding chair seat traversely when said locking mechanism is assembled with the gliding chair seat and having one end connected to said handle.

4. The locking mechanism according to claim 3, wherein, when said locking mechanism is assembled with the gliding chair seat, said lever mounted to the gliding chair seat is fixed by a tenon.

5. A glider rocker comprising:

a stationary base;

a gliding chair seat mounted on the stationary base; and a locking assembly including:

an operating assembly mounted on said gliding chair seat;

a pair of bearing brackets mounted on said stationary base respectively and each bearing bracket having an upper end provided with downwardly extending catch slots with equal depths; and a pair of mounting assemblies, each said mounting assembly comprising:

a) a prop fixed to said operating assembly and having a pin on a longitudinal face of said prop;

b) a strut connected to said prop pivotally and having a groove;

c) a curved elongated member connected to said strut pivotally and having a longitudinal face from which latch bars and a blocking bar transversely projects, said latch bars spaced along the length of said curved elongated member with respect to a gliding direction of said gliding chair seat; said blocking bar fit to said groove of said strut; said curved elongated member also having a pin on a reverse longitudinal face;

d) a mounting bracket with one end fixed to said gliding chair seat and another end fixed to said curved elongated member pivotally; and e) a restoring spring connected with said curved elongated member and said prop.

6. The glider rocker according to claim 5, wherein said restoring spring is fixed by said pin on the longitudinal face of said curved elongated member and said pin on the longitudinal face of said prop.

7. The glider rocker according to claim 5, wherein said operating assembly comprising:

a) a handle to manipulate said locking assembly; and b) a lever mounted on said gliding chair seat traversely and having one end connected to said handle.

8. The glider rocker according to claim 7, wherein said lever mounted to said gliding chair seat is fixed by a tenon.

* * * * *